US011111909B2

(12) United States Patent
Chang

(10) Patent No.: US 11,111,909 B2
(45) Date of Patent: Sep. 7, 2021

(54) LIQUID FOAM DELIVERY DEVICE

(71) Applicant: FANER AROMA PRODUCT CO., LTD., Guangzhou (CN)

(72) Inventor: Hsu-Hui Chang, New Taipei (TW)

(73) Assignee: FANER AROMA PRODUCT CO., LTD., Guangzhou (CN)

( * ) Notice: Subject to any disclaimer, the term of this patent is extended or adjusted under 35 U.S.C. 154(b) by 114 days.

(21) Appl. No.: 16/452,613

(22) Filed: Jun. 26, 2019

(65) Prior Publication Data

US 2020/0405101 A1 Dec. 31, 2020

(51) Int. Cl.

| | |
|---|---|
| ***F04B 23/10*** | (2006.01) |
| ***A47K 5/16*** | (2006.01) |
| ***B05B 7/00*** | (2006.01) |
| ***A47K 5/06*** | (2006.01) |
| ***F04B 23/08*** | (2006.01) |
| ***F04B 23/12*** | (2006.01) |

(52) U.S. Cl.

CPC ..... *F04B 23/10* (2013.01); *A47K 5/06* (2013.01); *A47K 5/16* (2013.01); *B05B 7/0018* (2013.01); *F04B 23/08* (2013.01); *F04B 23/12* (2013.01)

(58) Field of Classification Search

CPC ..... F04B 23/12; F04B 23/10; F04B 23/08; F04B 23/103; F04B 41/06; F04B 39/1046; F04B 39/1066; F04B 35/04; B05B 7/0018; A47K 5/16; A47K 5/06; A47K 45/047

USPC ..... 417/199.1, 199.2, 201, 560

See application file for complete search history.

(56) References Cited

U.S. PATENT DOCUMENTS

| | | | | |
|---|---|---|---|---|
| 4,181,477 A * | 1/1980 | Litt | F04B 53/1092 137/512.15 |
| 5,096,389 A * | 3/1992 | Grady | B01F 3/04446 169/14 |
| 6,523,498 B1 * | 2/2003 | Shyu | A01K 63/042 119/259 |
| 6,551,078 B2 * | 4/2003 | Huang | F04B 23/14 417/420 |
| 6,857,392 B1 * | 2/2005 | Shyu | A01K 63/047 119/245 |
| 2008/0260556 A1 * | 10/2008 | Hoffman | F04B 45/047 417/423.1 |

(Continued)

*Primary Examiner* — Charles G Freay

(74) *Attorney, Agent, or Firm* — Schmeiser, Olsen & Watts, LLP

(57) ABSTRACT

A liquid foam delivery device includes a pump proper, a linear transmission mechanism, a unidirectional input/output gas mechanism and a unidirectional input/output liquid mechanism. The pump proper has a rotating shaft. The linear transmission mechanism converts rotational motion output by the rotating shaft into linear reciprocating motion perpendicular to the rotating shaft. The unidirectional input/output gas mechanism admits gas into a gas inlet and discharge gas from a gas outlet in a direction perpendicular to the rotating shaft through the linear reciprocating motion of the linear transmission mechanism. The unidirectional input/output liquid mechanism delivers liquid admitted through a liquid inlet to a liquid outlet through the rotational motion output by the rotating shaft. The liquid foam delivery device delivers gas and liquid with only one pump proper and one rotating shaft to therefore minimize the required number of constituent components, achieve miniaturization, render assembly easy and cut cost.

4 Claims, 4 Drawing Sheets

(56) References Cited

U.S. PATENT DOCUMENTS

2018/0141064 A1* 5/2018 Takagi ..... B05B 7/0037

* cited by examiner

LIQUID FOAM DELIVERY DEVICE

BACKGROUND OF THE INVENTION

1. Field of the Invention

The present disclosure relates to delivery devices, and in particular to a liquid foam delivery device for delivering liquid foam with a single pump.

2. Description of the Related Art

Conventional cleaning liquids, such as face washes, hand washes and shower gels, are provided to consumers in the form of foam to enhance ease of use and reduce liquid consumption. The foam is produced by mixing gas and liquid with a foam maker.

The conventional foam maker includes a liquid pump and a gas pump. The liquid pump delivers the cleaning liquid. The gas pump delivers the gas. Then, the cleaning liquid and the gas mix at the outlet of the foam maker to form foam. However, two motors are required to control the liquid pump and the gas pump, respectively, to the detriment of space efficiency and power efficiency.

BRIEF SUMMARY OF THE INVENTION

In view of the drawback of a conventional liquid foam delivery device, an objective of the present disclosure is to provide a liquid foam delivery device for delivering liquid foam with a single pump.

To achieve at least the above objective, the present disclosure provides a liquid foam delivery device comprising: a motor having a rotating shaft; a linear transmission mechanism disposed at the rotating shaft to convert rotational motion output by the rotating shaft into linear reciprocating motion perpendicular to the rotating shaft; a unidirectional input/output gas mechanism connected to the linear transmission mechanism to admit gas into a gas inlet and discharge gas from a gas outlet in a direction perpendicular to the rotating shaft through the linear reciprocating motion of the linear transmission mechanism; and a unidirectional input/output liquid mechanism connected to the rotating shaft to deliver liquid admitted through a liquid inlet to a liquid outlet through the rotational motion output by the rotating shaft.

In an embodiment of the present disclosure, the linear transmission mechanism comprises an eccentric wheel, a bearing and a reciprocating transmission component. The eccentric wheel is eccentrically fitted around the rotating shaft. The bearing is fitted around the eccentric wheel. The reciprocating transmission component is fitted around the bearing. A push element is disposed at the outer rim of the reciprocating transmission component and extended away from the reciprocating transmission component to push the unidirectional input/output gas mechanism in a reciprocating manner through the rotational motion of the rotating shaft and the eccentric wheel.

In an embodiment of the present disclosure, the linear transmission mechanism further comprises a rotating shaft hermetic seal element fitted around the rotating shaft and disposed in the unidirectional input/output liquid mechanism.

In an embodiment of the present disclosure, the unidirectional input/output gas mechanism comprises a suction cup component and a film unidirectional valve component. The suction cup component has an end portion connected to the linear transmission mechanism. The suction cup component has a sucking surface connected to the film unidirectional valve component. The film unidirectional valve component is in communication with the gas inlet and the gas outlet.

In an embodiment of the present disclosure, the film unidirectional valve component comprises a front half valve, a rear half valve and a resilient film sheet. The front half valve is in communication with the suction cup component. The rear half valve is in communication with the gas inlet and the gas outlet. The front half valve and the rear half valve together define a gas-receiving space. The resilient film sheet is disposed in the gas-receiving space.

In an embodiment of the present disclosure, the rear half valve has a rear protruding opening portion in communication with the gas inlet and a rear dented opening portion in communication with the gas outlet. The front half valve has a front dented opening portion opposite the rear protruding opening portion and has a front protruding opening portion opposite the rear dented opening portion. The resilient film sheet has two resilient valves disposed between the front dented opening portion and the rear protruding opening portion and between a front protruding opening portion and the rear dented opening portion, respectively.

In an embodiment of the present disclosure, the unidirectional input/output liquid mechanism comprises an input/output liquid casing and a gear train. The input/output liquid casing has a liquid-receiving space as well as the liquid inlet and the liquid outlet which are in communication with the liquid-receiving space. The gear train is disposed in the liquid-receiving space. The rotating shaft rotates and drives the gear train to rotate such that the liquid admitted through the liquid inlet is delivered to the liquid outlet.

In an embodiment of the present disclosure, the gear train comprises a driving gear directly driven by the rotating shaft and a driven gear driven by the driving gear. The tangential direction at the point of the meshing of the driving gear and the driven gear points at the liquid outlet.

In an embodiment of the present disclosure, the liquid foam delivery device further comprises a deceleration mechanism fitted around the rotating shaft and disposed between the linear transmission mechanism and the unidirectional input/output liquid mechanism. The deceleration mechanism lowers the rotation speed of the gear train.

In an embodiment of the present disclosure, the deceleration mechanism comprises a small driving wheel, a large driven wheel and a transmission belt. The small driving wheel is fitted around the rotating shaft. The transmission belt is connected to the small driving wheel and the large driven wheel to lower the rotation speed of the large driven wheel. The gear train and the large driven wheel are coaxial.

In conclusion, the liquid foam delivery device of the present disclosure delivers gas and liquid with only one motor and one rotating shaft simultaneously and respectively to minimize the required number of constituent components, achieve miniaturization, render assembly easy and cut cost.

DETAILED DESCRIPTION OF THE INVETION

To facilitate understanding of the object, characteristics and effects of this present disclosure, embodiments together with the attached drawings for the detailed description of the present disclosure are provided. The present disclosure is implemented or applied by other different, specific embodiments. Various modifications and changes can be made in accordance with different viewpoints and applications to details disclosed herein without departing from the spirit of the present disclosure. Furthermore, the accompanying drawings of the present disclosure are illustrative but are not drawn to scale. Technical features of the present disclosure are illustrated by embodiments and described below, but the embodiments are not restrictive of the claims of the present disclosure.

Figure 1:
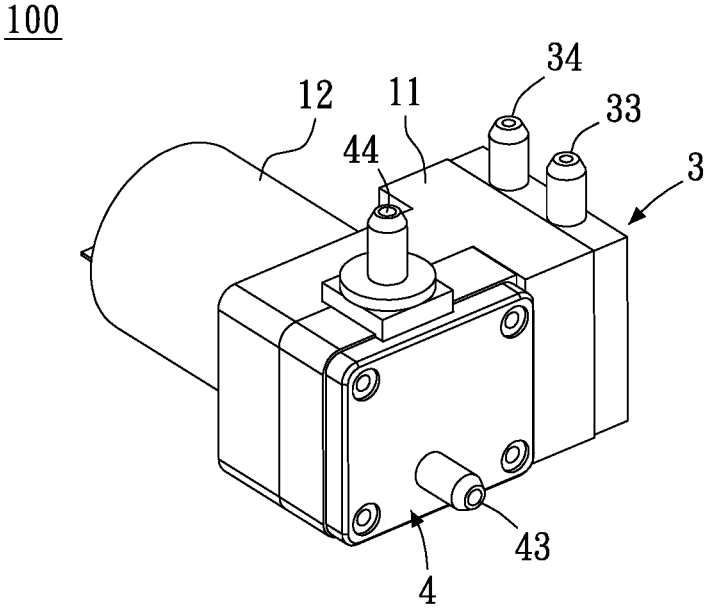
FIG. 1 is a perspective view of a liquid foam delivery device according to the first embodiment of the present disclosure.
Figure 2:
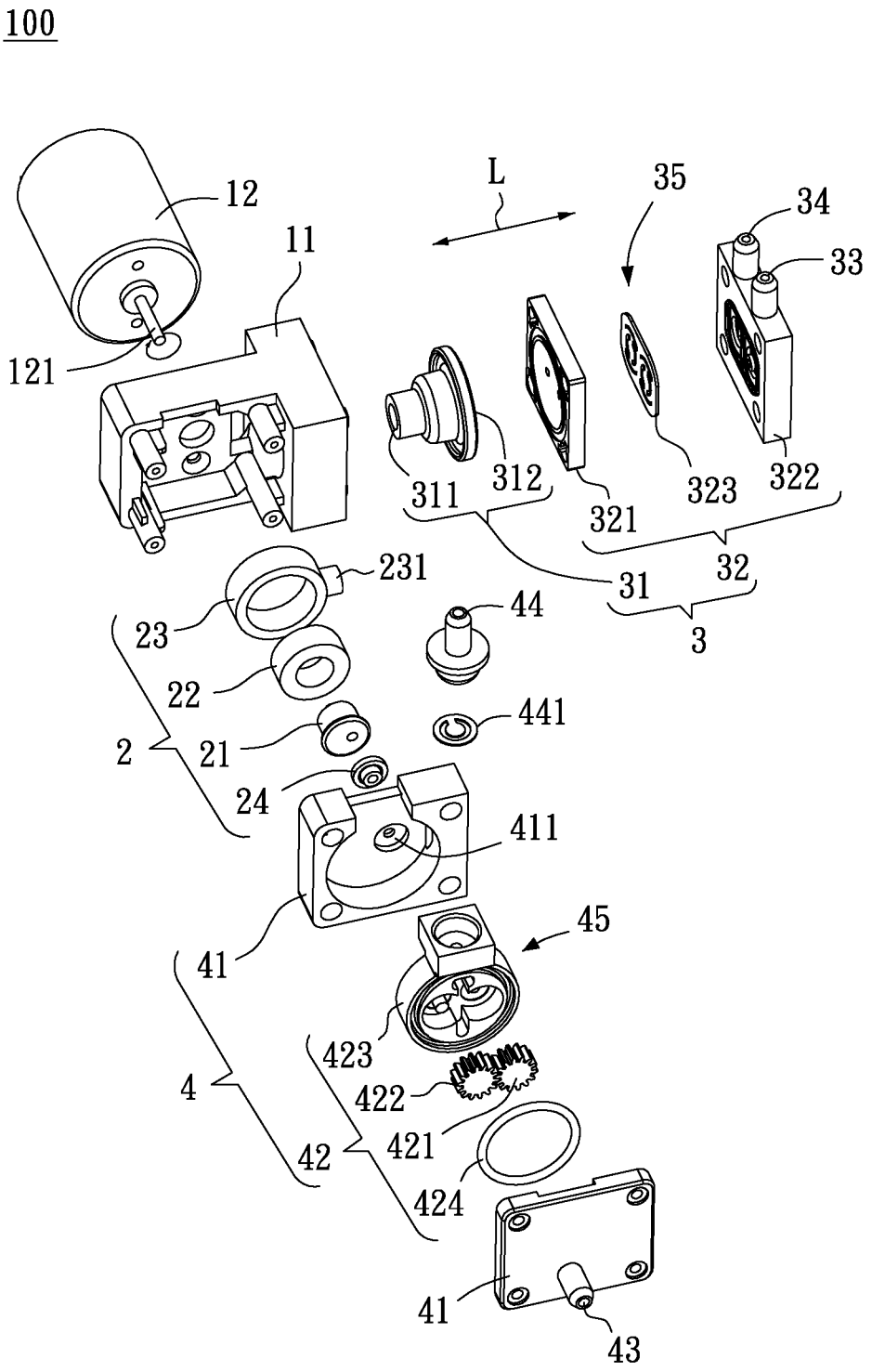
FIG. 2 is an exploded view of the liquid foam delivery device according to the first embodiment of the present disclosure.

Referring to FIG. 1 and FIG. 2, a liquid foam delivery device 100 in an embodiment of the present disclosure comprises a motor 12, a linear transmission mechanism 2, a unidirectional input/output gas mechanism 3 and a unidirectional input/output liquid mechanism 4.

The motor 12 comprises a stationary casing 11 and has a rotating shaft 121 for generating rotational force (as indicated by the arrow in FIG. 2).

The linear transmission mechanism 2 is disposed at the rotating shaft 121 and the stationary casing 11 to convert the rotational motion output by the rotating shaft 121 into the linear reciprocating motion perpendicular to the rotating shaft 121. The linear reciprocating motion takes place in the reciprocating direction L shown in FIG. 2.

The unidirectional input/output gas mechanism 3 is connected to the linear transmission mechanism 2 and the stationary casing 11. The unidirectional input/output gas mechanism 3 admits gas into a gas inlet 33 and discharges gas from a gas outlet 34 in the reciprocating direction L perpendicular to the rotating shaft 121 through the linear reciprocating motion of the linear transmission mechanism 2.

The unidirectional input/output liquid mechanism 4 is connected to the rotating shaft 121 and the stationary casing 11. The unidirectional input/output liquid mechanism 4 delivers the liquid admitted through a liquid inlet 43 to a liquid outlet 44 through the rotational motion output by the rotating shaft 121.

The liquid foam delivery device of the present disclosure delivers gas and liquid with only one motor 12 and one rotating shaft 121 simultaneously and respectively, so as to minimize the required number of constituent components, achieve miniaturization, render assembly easy and cut cost.

Referring to FIG. 2, in this embodiment, the linear transmission mechanism 2 comprises an eccentric wheel 21, a bearing 22 and a reciprocating transmission component 23 which are disposed in the stationary casing 11. The eccentric wheel 21 is eccentrically fitted around the rotating shaft 121. The bearing 22 is fitted around the eccentric wheel 21 such that the eccentric wheel 21 rotates within the bearing 22. The reciprocating transmission component 23 is fitted around the bearing 22. A push element 231 is disposed at the outer rim of the reciprocating transmission component 23 and extended away from the reciprocating transmission component 23. Owing to the rotational motion of the eccentric wheel 21 and the rotating shaft 121, the push element 231 of the reciprocating transmission component 23 undergoes reciprocating motion in the reciprocating direction L and thereby pushes the unidirectional input/output gas mechanism 3 in a reciprocating manner. Therefore, owing to the eccentric rotational motion of the eccentric wheel 21, the rotational motion of the rotating shaft 121 is converted into the linear reciprocating motion perpendicular to the rotating shaft 121.

Referring to FIG. 2, in this embodiment, the linear transmission mechanism 2 further comprises a rotating shaft hermetic seal element 24 fitted around the rotating shaft 121 and a receiving chamber 411 disposed in the unidirectional input/output liquid mechanism 4. Therefore, the rotating shaft hermetic seal element 24 stops liquid from seeping out of the unidirectional input/output liquid mechanism 4 and into the linear transmission mechanism 2 and the motor 12 by propagating along the rotating shaft 121.

Figure 3A:
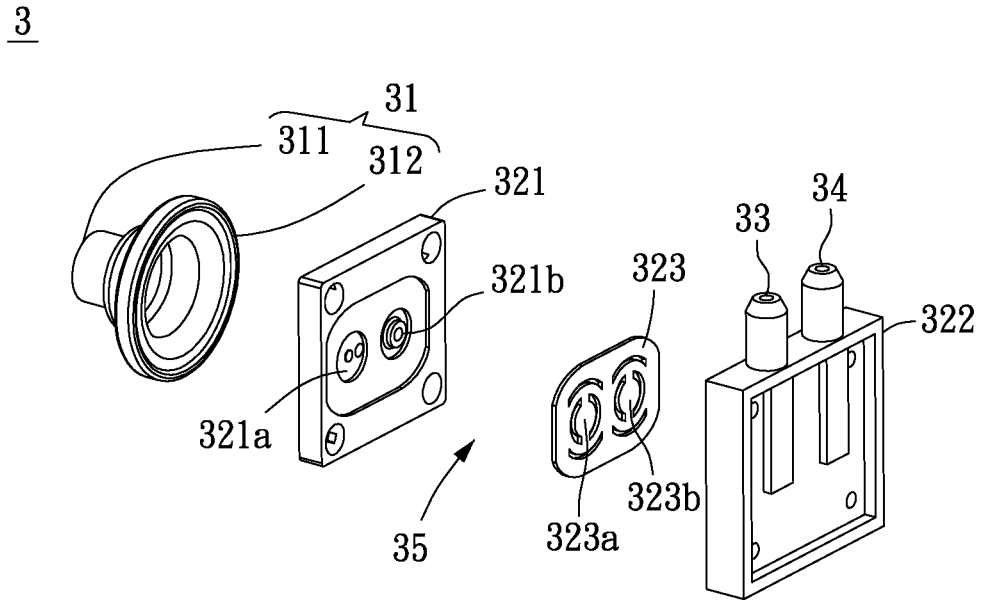
FIG. 3A is a partial exploded view of a unidirectional input/output gas mechanism taken from different angles according to the first embodiment of the present disclosure.
Figure 3B:
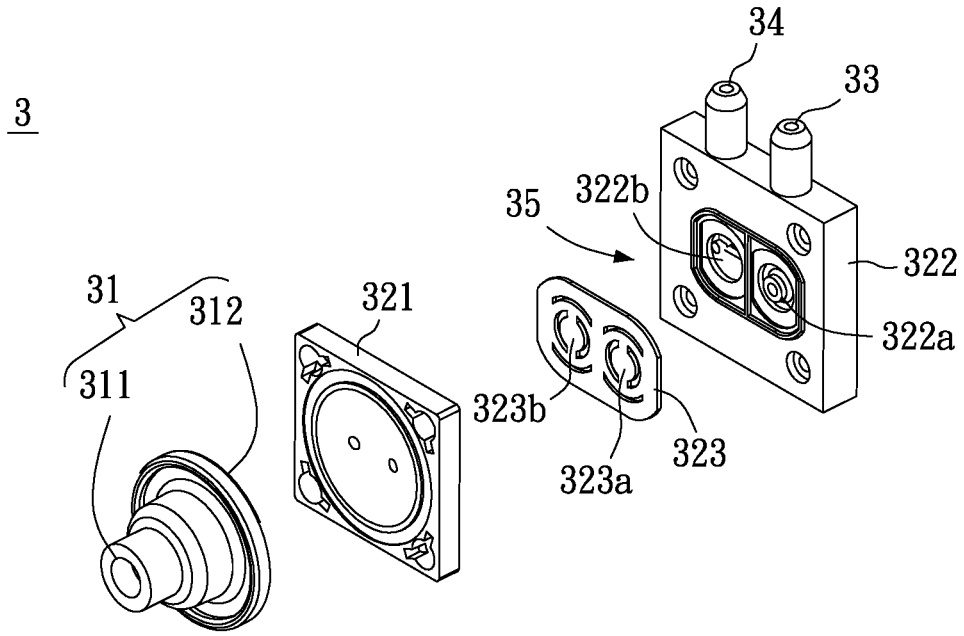
FIG. 3B is a partial exploded view of a unidirectional input/output gas mechanism taken from different angles according to the first embodiment of the present disclosure.

Referring to FIG. 2 through FIG. 3B, in this embodiment, the unidirectional input/output gas mechanism 3 comprises a suction cup component 31 disposed in the stationary casing 11 and a film unidirectional valve component 32 disposed in the stationary casing 11. The suction cup component 31 has an end portion 311 connected to the linear transmission mechanism 2. The suction cup component 31 has a sucking surface 312 connected to the film unidirectional valve component 32. The film unidirectional valve component 32 is in communication with the gas inlet 33 and the gas outlet 34. Therefore, the combination of the suction cup component 31 and the film unidirectional valve component 32, coupled with the linear reciprocating motion attained with the linear transmission mechanism 2, allows the suction cup component 31 to be compressed and stretched repeatedly, to not only enable the gas to be delivered from the gas inlet 33 to the gas outlet 34 unidirectionally through the film unidirectional valve component 32, but also output the slightly-pressurized gas, thereby rendering the finally-produced foam abundant.

Referring to FIG. 2 through FIG. 3B, in this embodiment, the film unidirectional valve component 32 comprises a front half valve 321, a rear half valve 322 and a resilient film sheet 323. The front half valve 321 is disposed at the stationary casing 11 and in communication with the suction cup component 31. The rear half valve 322 is in communication with the gas inlet 33 and the gas outlet 34. The front half valve 321 and the rear half valve 322 together define a gas-receiving space 35. The resilient film sheet 323 is disposed in the gas-receiving space 35. The suction cup component 31 changes the direction in which the gas in the gas-receiving space 35 flows and thus causes the resilient film sheet 323 to vibrate in a reciprocating manner, thereby the gas is admitted to the gas-receiving space 35 through the gas inlet 33 and discharged from the gas outlet 34.

Referring to FIG. 3A and FIG. 3B, in this embodiment, the rear half valve 322 has a rear protruding opening portion 322*a* in communication with the gas inlet 33 and a rear dented opening portion 322*b* in communication with the gas outlet 34. The front half valve 321 has a front dented opening portion 321*a* opposite the rear protruding opening portion 322*a* and has a front protruding opening portion 321*b* opposite the rear dented opening portion 322*b*. The resilient film sheet 323 has two resilient valves 323*a*, 323*b* disposed between the front dented opening portion 321*a* and the rear protruding opening portion 322*a* and between the front protruding opening portion 321*b* and a rear dented opening portion 321*b*, respectively. The front dented opening portion 321*a* and the front protruding opening portion 321*b* are in communication with the suction cup component 31. When the suction cup component 31 admits gas, the gas is admitted to the gas-receiving space 35 through the gas inlet 33 and the rear protruding opening portion 322*a*; meanwhile, the two resilient valves 323*a*, 323*b* are pulled toward the suction cup component 31, with the resilient valve 323*b* abutting against the front protruding opening portion 321*b*, and in consequence the front protruding opening portion 321*b* is clogged; as a result, the gas cannot retreat to the gas-receiving space 35 through the gas outlet 34. When the suction cup component 31 is compressed, the gas enters the gas-receiving space 35 through the suction cup component 31, causing the two resilient valves 323*a*, 323*b* to move away from the suction cup component 31; meanwhile, the resilient valve 323*a* abuts against the rear protruding opening portion 322*a*, and thus the gas cannot be discharged through the gas inlet 33. Furthermore, the gas is discharged from the film unidirectional valve component 32 through the rear dented opening portion 321*b* and the gas outlet 34. Therefore, the film unidirectional valve component functions as the gas unidirectional valve, using the two resilient valves 323*a*, 323*b*, the front dented opening portion 321*a*, the front protruding opening portion 321*b*, the rear protruding opening portion 322*a*, and the rear dented opening portion 321*b*.

Referring to FIG. 2, in this embodiment, the unidirectional input/output liquid mechanism 4 comprises an input/output liquid casing 41 and a gear train 42 which are disposed in the stationary casing 11. The input/output liquid casing 41 has a liquid-receiving space 45 as well as the liquid inlet 43 and the liquid outlet 44 which are in communication with the liquid-receiving space 45. The gear train 42 is disposed in the liquid-receiving space 45. The rotating shaft 121 rotates and drives the gear train 42 to rotate such that the liquid admitted through the liquid inlet 43 is delivered to the liquid outlet 44. Therefore, the unidirectional input/output liquid mechanism 4 delivers the liquid directly under the rotational force of the rotating shaft 121.

Referring to FIG. 2, in this embodiment, the gear train 42 comprises a driving gear 421 directly driven by the rotating shaft 121 and a driven gear 422 driven by the driving gear 421. The gear train 42 further comprises a gear seat 423 and a hermetic seal ring 424. The gear seat 423 is disposed in the liquid-receiving space 45 so as to be in communication with the liquid outlet 44. The hermetic seal ring 424 is disposed between the gear seat 423 and the input/output liquid casing 41 such that the gear seat 423 and the input/output liquid casing 41 fit each other tightly. The rotating shaft 121 rotates and drives the driving gear 421 and the driven gear 422 to rotate within the gear seat 423, and in consequence the tangential direction at the point of the meshing of the driving gear 421 and the driven gear 422 points at the liquid outlet 44. Therefore, upon its entry into the liquid-receiving space 45 through the liquid inlet 43, the liquid is delivered to the liquid outlet 44 ceaselessly because of the rotation of the driving gear 421 and the driven gear 422. The liquid outlet 44 has therein a unidirectional valve element 441 for preventing the liquid from retreating to the input/output liquid casing 41.

Figure 4:
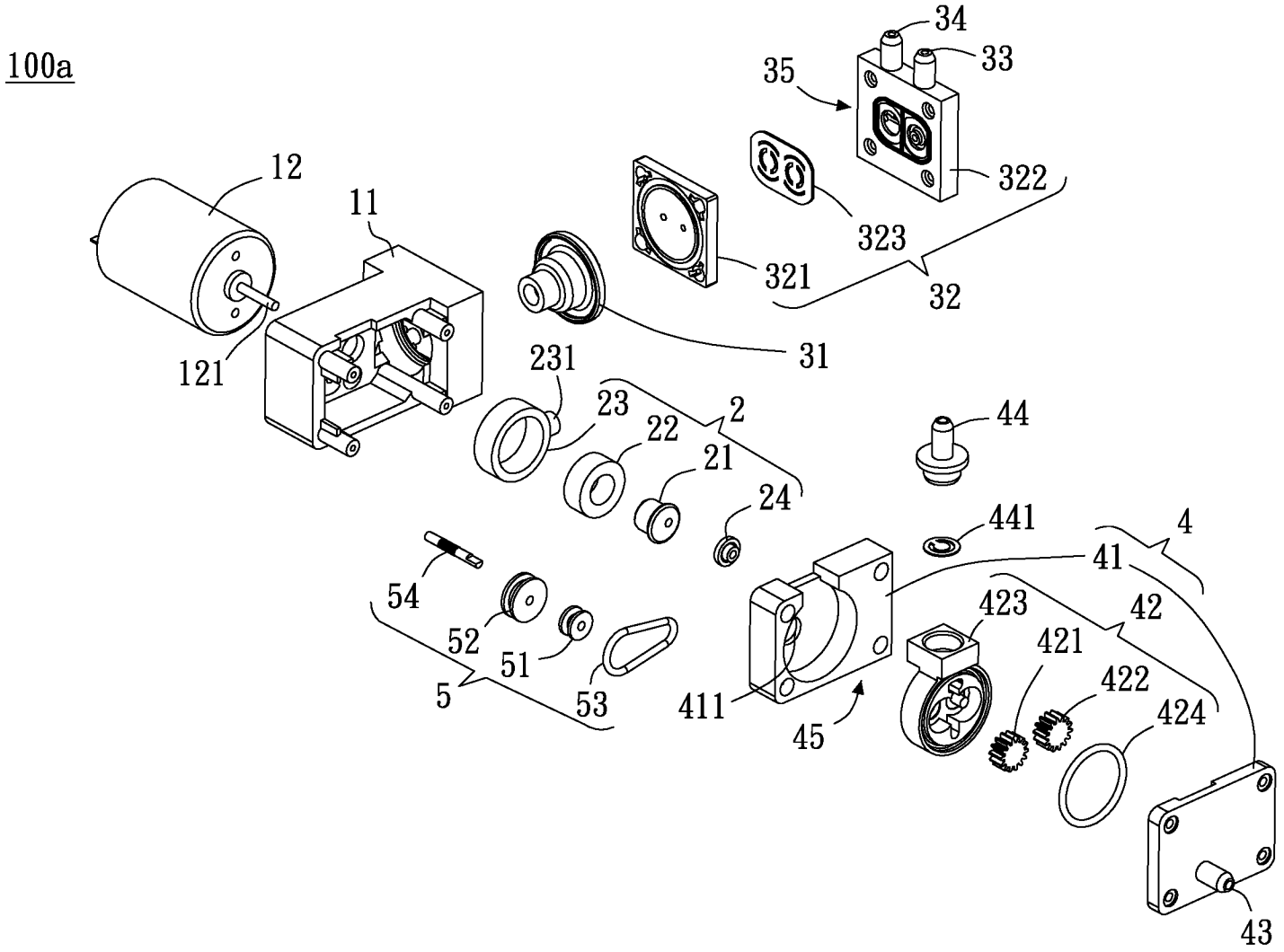
FIG. 4 is an exploded view of the liquid foam delivery device according to the second embodiment of the present disclosure.

The liquid foam delivery device 100*a* in the second embodiment shown in FIG. 4 is substantially the same as the liquid foam delivery device 100 in the first embodiment shown in FIG. 2 except for the technical features described below. The liquid foam delivery device 100*a* further comprises a deceleration mechanism 5 fitted around the rotating shaft 121 and disposed between the linear transmission mechanism 2 and the unidirectional input/output liquid mechanism 3. The deceleration mechanism 5 lowers the rotation speed of the gear train 42. With the deceleration mechanism 5 being capable of adjusting the rotation speed of the gear train 42, the actual ratio of the flow rate of the gas to the flow rate of the liquid can be adjusted to an expected ratio, for example, 1:4 to 1:40.

Referring to FIG. 4, in this embodiment, the deceleration mechanism 5 comprises a small driving wheel 51, a large driven wheel 52 and a transmission belt 53. The small driving wheel 51 is fitted around the rotating shaft 121 and thus directly driven by the rotating shaft 121. The transmission belt 53 is connected to the small driving wheel 51 and the large driven wheel 52 to lower the rotation speed of the large driven wheel 52. The driving gear 421 of the gear train 42 and the large driven wheel 52 are coaxial 54. Therefore, by adjusting the ratio of the diameter of the small driving wheel 51 to the diameter of the large driven wheel 52, the deceleration ratio of the gear train 42 is placed under control.

While the present disclosure has been described by means of specific embodiments, numerous modifications and variations could be made thereto by those skilled in the art without departing from the scope and spirit of the present disclosure set forth in the claims.

What is claimed is:

1. A liquid foam delivery device, comprising:

a motor having a rotating shaft;

a linear transmission mechanism disposed at the rotating shaft;

a unidirectional input/output gas mechanism connected to the linear transmission mechanism; and a unidirectional input/output liquid mechanism connected to the rotating shaft, wherein the unidirectional input/output liquid mechanism comprises an input/output liquid casing and a gear train, the input/output liquid casing has a liquid-receiving space as well as a liquid inlet and a liquid outlet which are in communication with the liquid-receiving space, the gear train is disposed in the liquid-receiving space to rotate when driven by the rotating shaft, so as to deliver a liquid admitted through the liquid inlet to the liquid outlet, wherein the linear transmission mechanism comprises an eccentric wheel, a bearing and a reciprocating transmission component, the eccentric wheel is eccentrically fitted around the rotating shaft, the bearing is fitted around the eccentric wheel, the reciprocating transmission component is fitted around the bearing, and an outer rim of the reciprocating transmission component is provided with a push element, a protruding direction of the push element is perpendicular to an axial direction of the rotating shaft, the reciprocating transmission component pushes the unidirectional input/output gas mechanism in a reciprocating manner by the rotational motion of the rotating shaft and the eccentric wheel, the unidirectional input/output gas mechanism comprises a suction cup component and a film unidirectional valve component, the suction cup component has an end portion connected to the reciprocating transmission component and has a sucking surface connected to the film unidirectional valve component, and the film unidirectional valve component includes a gas inlet and a gas outlet, the film unidirectional valve component comprises a first half valve adjacent to the suction cup component, a second half valve away from the suction cup component and a resilient film sheet, the first half valve is in communication with the suction cup component, the second half valve includes the gas inlet and the gas outlet, the first half valve and the second half valve together define a gas-receiving space, the gas-receiving space is in communication with the gas inlet and the gas outlet, and the resilient film sheet is disposed in the gas-receiving space, the second half valve has a second protruding opening portion in communication with the gas inlet and a second dented opening portion in communication with the gas outlet, the first half valve has a first dented opening portion opposite the second protruding opening portion and has a first protruding opening portion opposite the second dented opening portion, and the resilient film sheet has two resilient valves disposed between the first dented opening portion and the second protruding opening portion and between the first protruding opening portion and the second dented opening portion, respectively, the unidirectional input/output gas mechanism admits gas into the gas inlet and discharges gas from the gas outlet in a direction perpendicular to the rotating shaft through the linear reciprocating motion of the linear transmission mechanism.

2. The liquid foam delivery device of claim 1, wherein the linear transmission mechanism further comprises a rotating shaft hermetic seal element fitted around the rotating shaft and disposed in the unidirectional input/output liquid mechanism.

3. The liquid foam delivery device of claim 1, wherein the gear train comprises a driving gear directly driven by the rotating shaft and a driven gear driven by the driving gear, and a tangential direction at a point of meshing the driving gear and the driven gear points toward the liquid outlet.

4. The liquid foam delivery device of claim 1, further comprising a deceleration mechanism fitted around the rotating shaft, the deceleration mechanism comprises a small driving wheel, a large driven wheel and a transmission belt, the small driving wheel is fitted around the rotating shaft, and the transmission belt is connected to the small driving wheel and the large driven wheel to lower a rotation speed of the large driven wheel, the gear train includes a driving gear, the large driven wheel and the driving gear are coaxial.

* * * * *